US010563413B2

(12) United States Patent
DuPree

(10) Patent No.: US 10,563,413 B2
(45) Date of Patent: Feb. 18, 2020

(54) PUMP JACK SCAFFOLD SYSTEM

(71) Applicant: DuPree Construction, Joliet, IL (US)

(72) Inventor: David DuPree, Joliet, IL (US)

( * ) Notice: Subject to any disclaimer, the term of this patent is extended or adjusted under 35 U.S.C. 154(b) by 0 days.

(21) Appl. No.: 14/807,374

(22) Filed: Jul. 23, 2015

(65) Prior Publication Data

US 2017/0022723 A1 Jan. 26, 2017

(51) Int. Cl.
*E04G 7/02* (2006.01)
*E04G 5/00* (2006.01)

(52) U.S. Cl.
CPC ..... *E04G 7/02* (2013.01); *E04G 5/001* (2013.01)

(58) Field of Classification Search
CPC ..... E04G 5/001; E04G 7/02
See application file for complete search history.

(56) References Cited

U.S. PATENT DOCUMENTS 4,002,222 A * 1/1977 Bruno ..... E04G 1/15 182/113
4,597,471 A * 7/1986 Anderson ..... A63B 27/04 182/132
4,624,342 A * 11/1986 Anderson ..... E04G 1/20 182/119
6,354,758 B1 * 3/2002 Chaulk ..... E04G 1/15 182/222
2005/0061581 A1 * 3/2005 Morris ..... E04G 1/20 182/82

* cited by examiner

*Primary Examiner* — Alvin C Chin-Shue

(57) ABSTRACT

A scaffold that is quick and easy to assemble while still implementing safety measures. The scaffold can include end caps that resist or prevent users from falling off the ends of the scaffold. The end caps are quickly assembled to the scaffold with a removable rod and pin mechanism. Moreover, to prevent a user from falling off the front or back of the scaffold, a pole and a mid-rail connector can be connected to the scaffold across the front or back, respectively, between an upper barrier and a lower platform. The pole can be inserted through connectors that are coupled to the scaffold, and can also be connected to mid-rail brackets for additional structural stability.

4 Claims, 4 Drawing Sheets

PUMP JACK SCAFFOLD SYSTEM

TECHNICAL FIELD OF THE INVENTION

The present invention relates generally to scaffold systems. More particularly, the present invention relates to a pump jack scaffold system having components that assemble quickly and easily.

BACKGROUND OF THE INVENTION

Scaffolds are used in many applications where workers need access to an elevated space. A conventional scaffold includes a movable platform that workers can stand on and that is raised, lowered, or moved side-to-side, depending on the application. Scaffolds are advantageous because they are typically portable and can be reused in various different applications to help workers gain access to elevated spaces.

Pump jack scaffolds include a movable platform supported by brackets on vertical poles. The brackets can be raised or lowered to likewise raise or lower the platform. Pump jack scaffolds can, therefore, be easily adjusted to various different heights, making them appealing in a variety of applications.

Safety measures are necessary for scaffold systems because users can be seriously injured if they fall off the scaffold platforms. Conventional pump jack scaffolds include a net connected to different parts of the scaffold to catch users when they fall from the platform. Other scaffold systems include end caps located on the side of the scaffold that resist a user from falling off the side of the platform. The safety measures of conventional scaffold systems require considerable time to connect to the scaffold system. Workers are left waiting for the safety measures to be assembled, wasting significant time and increasing the expense of the project in which the scaffold is used. Sometimes, to avoid the hassle and expenditure of time, workers forgo assembly and use of the safety measures, thus subjecting themselves to risks of injury or death.

SUMMARY OF THE INVENTION

The present invention broadly comprises a quick and easy to assemble scaffold. In an embodiment, the scaffold includes end caps that connect to the platform with a removable rod and pin mechanism to resist or prevent users from falling off the end of the scaffold. The scaffold can further include a pole and a mid-rail connector located between a top barrier and a lower platform to prevent the user from falling off a front or back of the scaffold. The pole can be assembled to the scaffold by inserting the pole through connectors and the mid-rail bracket. The scaffold can, therefore, implement safety measures while still being quickly assembled, reducing wasted time and improving the efficiency of the project in which the scaffold is used.

In particular, the present invention broadly includes a scaffold having an end cap with an end cap body and a rod extending from the end cap body. The scaffold also has a rail having a rail hole adapted to receive the rod. The rail has a first side proximate the end cap body and a second side opposite the first side. A pin is coupled to the end cap proximate the second side and extends beyond an outer circumference of the rod.

In another embodiment, the present invention can further include a scaffold including a beam, a rack movably disposed on the beam, a barrier coupled to the rack, a platform coupled to the rack below the barrier, and a mid-rail connector coupled to the barrier between the platform and the barrier. A pole extends through the mid-rail connector to resist or prevent users from falling off the scaffold.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
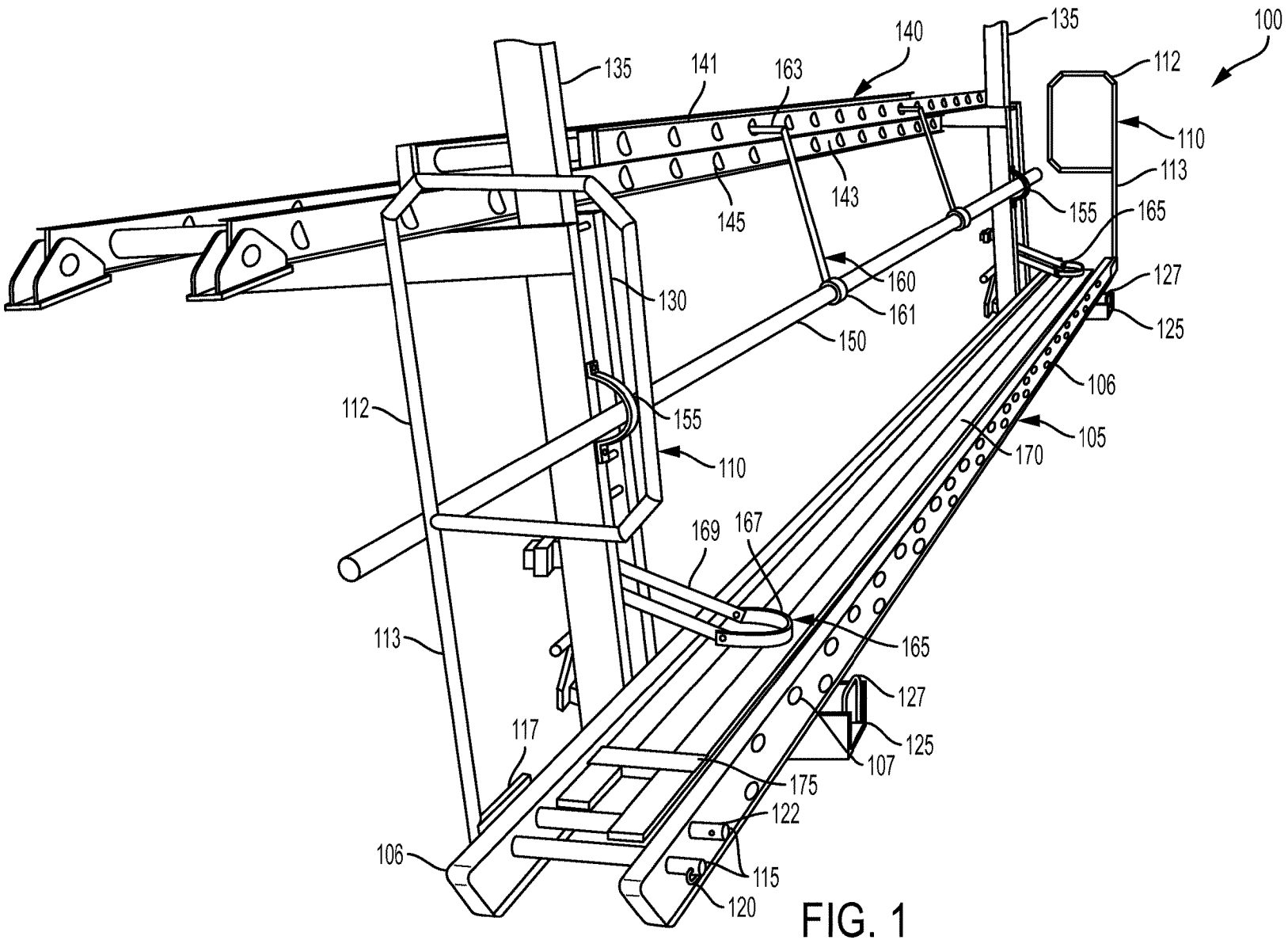
FIG. 1 is a side perspective view of a scaffold system according to embodiments of the present invention.
Figure 2:
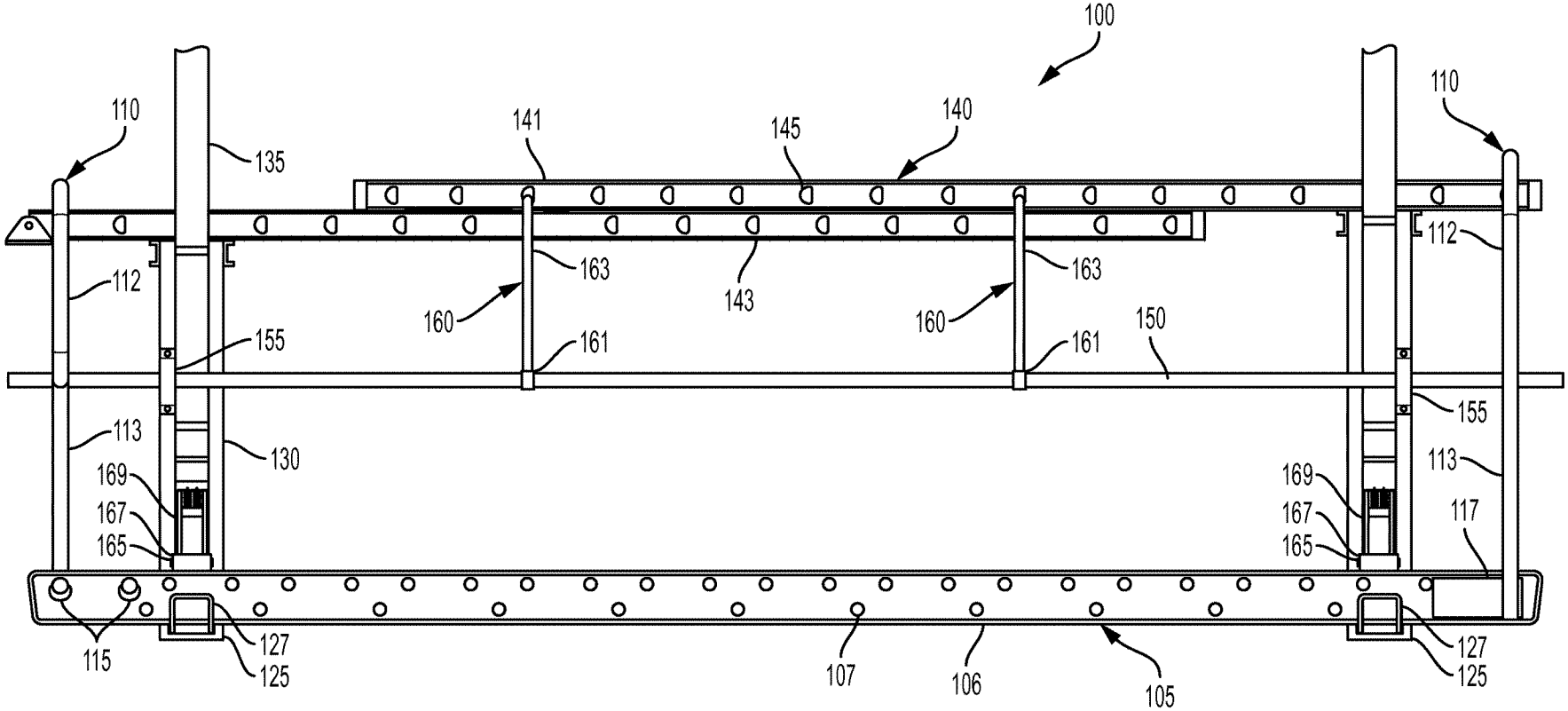
FIG. 2 is a front view of the scaffold system shown in FIG. 1.
Figure 3:
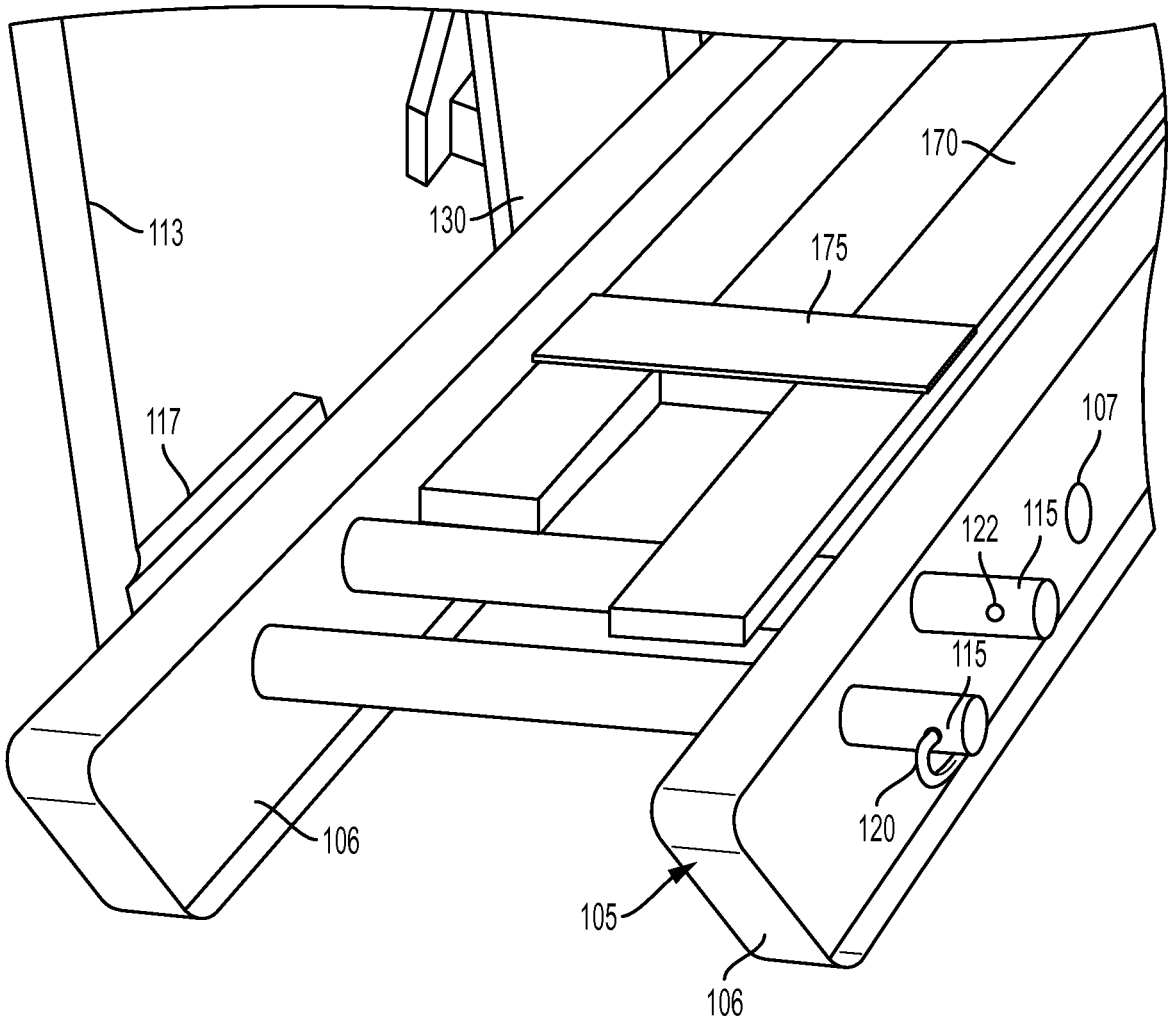
FIG. 3 is an enlarged front perspective view of the scaffold system shown in FIG. 1.
Figure 4:
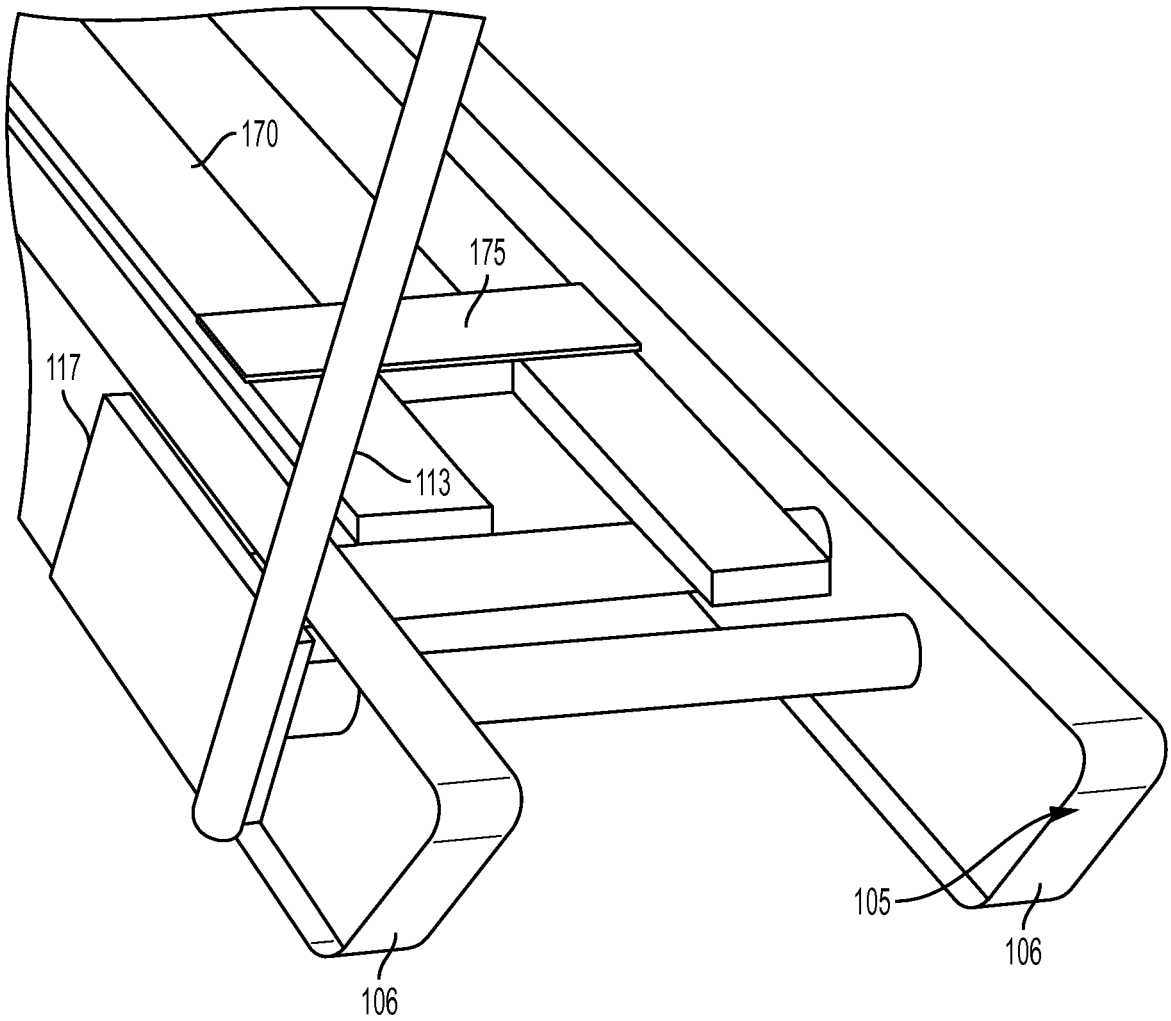
FIG. 4 is an enlarged rear perspective view of the scaffold system shown in FIG. 1.

While this invention is susceptible of embodiments in many different forms, there is shown in the drawings, and will herein be described in detail, embodiments of the invention, including a preferred embodiment, with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly comprises a scaffold system with a safety measure that is quick and easy to assemble. For example, the scaffold can include end caps that connect to ends of the platform to resist or prevent users from falling off the end of the scaffold. The end caps are quickly assembled to the scaffold by implementing a removable rod and pin mechanism. A pole and a mid-rail connector can also be used to prevent the user from falling off a front or back of the scaffold. For example, the pole can extend across the front of the scaffold and can further be inserted through connectors that are coupled to the scaffold. The scaffold of the present invention can therefore be quickly assembled, providing the necessary safety measure while reducing wasted time of the project in which the scaffold is used.

Referring to the Figures, a scaffold 100 includes a platform 105 where users can stand while gaining access to an elevated area. The platform 105 can be coupled to one or more rails 106 for structural support. The rails 106 can include rail holes 107 that allow an end cap 110 to be connected to the platform 105. For example, the end cap 110 can include an end cap body 112 and an end cap extension 113 extending from the end cap body 112. The end cap 110 can couple to the platform 105 by extending one or more rods 115 through the rail holes 107. In some embodiments, the end cap 110 can include a plate 117 coupled to the end cap extension 113 on a first side of the platform 105, and a pin 120 coupled to the rod 115 on a second side of the platform 105, opposite the first side. For example, the rod 115 can include opposing first and second ends, with the plate 117 coupled to the rod 115 proximate the first end and the pin 120 coupled to the rod 115 proximate the second end. The pin 120 can extend through an opening 122 on the second side of the platform 105 and resist the rod 115 from moving through the rail hole 107 from the second side of the platform 105. Similarly, the plate 117 can resist the rod 115 from extending through the rail hole 107 from the first side of the platform 105. In this manner, the end cap 110 can securely couple to the platform 105 and resist or prevent users from falling off the sides of the scaffold 100.

The platform 105 can rest on one or more bases 125. The base 125 can include a guide 127 that resists or prevents movement of the platform on the base 125. The base 125 can be coupled to a rack 130 that is movably disposed on a beam 135. The rack 130 can also be coupled to a barrier 140 having an upper barrier 141 movably disposed with respect to a lower barrier 143. The barrier 140 can be adjustable to fit various different sized scaffold 100 systems, and can be structured similar to a conventional ladder to prevent users from falling off the scaffold 100 in the area in which the barrier 140 is disposed.

The barrier 140 can include barrier holes 145 that couple to a mid-rail system. For example, a pole 150 can extend laterally along a length of the scaffold 100 to prevent users from falling off the scaffold 100. The pole 150 can be coupled to the rack 130 by a bracket 155 and rest within the bracket 155. In addition, the pole 150 can be connected to the barrier 140 by a mid-rail connector 160. The mid-rail connector 160 can include coupling 161 that couples to the pole 150 at a first end, and a mid-rail extension 163 extending from the coupling 161 and connecting to the barrier 140 at a second end of the mid-rail connector 160 opposite the first end. In this manner, the pole 150 can be located between the barrier 140 and the platform 105, and resist or prevent users from falling from the scaffold 100.

The scaffold 100 can also include a foot lock 165 for users to place their legs or feet while working on the scaffold 100. The foot lock 165 further prevents users from falling off the scaffold 100 by improving the user's balance on the scaffold 100. The foot lock 165 can be coupled to the rack 130 and extend to an area located proximate the platform 105. As shown, the foot lock 165 can include a foot hold 167 and straps 169 extending from the foot hold 167. Together, the foot hold 167 and straps 169 collectively secure a user's foot, ankle, or leg to improve balance and resist the user from falling off the scaffold.

In an embodiment, the platform 105 can include planks 170 and a side board 175 to form the area of the platform 105 where a user can stand. However, the platform 105 can be any size or shape that provides structural support for a user to stand. For example, the platform 105 can include a single piece of material or multiple pieces of material coupled together by any known means.

The end cap 110 can be any size or shape that resists or prevents a user from falling off the scaffold 100. As shown, the end cap 110 is p-shaped or q-shaped. Alternately, the end cap 110 can be a solid wall, H-shaped, X-shaped, or any other shape. In an embodiment, the end cap extension 113 couples to a plate 117 that then couples to the platform at a first end. However, the end cap 110 can couple to the platform 105 at both the first end of the platform 105 and at a second end opposite the first end, for example, in an H-shape. The end cap 110 can further include multiple end cap extensions 113 and plates 117 to couple to the platform 105 at multiple points. Any other size, shape, or structure of end cap 110 can be implemented without departing from the spirit and scope of the present invention.

In an embodiment, the end cap 110 can include two rods 115 respectively extending through the platform holes 106. Implementing multiple rods 115 provides additional structural stability to the end cap 110 by resisting rotation of the end cap 110 about either rod. For example, implementing a single rod 115 may allow the end cap 110 to rotate about the rod 115 and limit structural stability. Although any number of rods 115 can be implemented, a single rod 115 embodiment may benefit from additional structural measures to prevent rotation of the end cap 110 about the rod 115. Further, the rod 115 can be solid, hollow, or be made of several different materials, for example, in a composite arrangement.

The guide 127 can be any shape or size so as to resist movement of the platform 105 about the base 125. In an embodiment, the guide 127 can extend above the base 125 from a bottom of the base 125. In some embodiments, the guide 127 is integral with the base 125 rather than a separate component connected to the base 125.

The bracket 155 can be any shape capable of receiving the pole 150. For example, in an embodiment, the bracket 155 can be a semi-circular component coupled to the rack 130. However, the bracket 155 can also be a square, circular, triangular, or any other shape. Further, the bracket 155 need not be permanently coupled to the rack 130 or any other component of the scaffold 100, and can be removable from the rack 130 or any other component of the scaffold 100.

The pin 120 can be any shape capable of inserting through the opening 122 in the rod 115 and extending beyond the outer circumference of the rod 115 to prevent the rod 115 from passing completely through the rail hole 107. In some embodiments, the pin 120 need not insert into the opening 122 at all, and instead can clip on to the rod 115, for example, in a groove of the rod 115. The pin 120 can therefore be a C-clip in a groove. In an embodiment, the pin 120 is a D-ring inserted through the opening 122. The D-ring embodiment facilitates assembly and disassembly of the scaffold 100 by allowing a quick insertion or removal of the pin 120.

Several elements of the present invention are discussed above with single or plural terms. However, each element discussed above can be singular or plural in number, and the examples above are merely exemplary.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A scaffold comprising:

a platform having a first rail and a second rail, wherein the first rail includes a first plurality of holes positioned parallel to a second plurality of holes within the second rail, wherein the first plurality of holes are concentrically aligned with the second plurality of holes;

an end cap having:

an end cap body;

a first plate having a front face and a rear face with two rods extending in parallel from the rear face;

an end cap extension connecting the end cap body to the first plate;

wherein, the rods on the first plate are positioned to each engage two or more holes of the first plurality of holes of the first rail and two or more holes of the second plurality of holes that are concentrically aligned with the two or more holes of the first plurality of holes, and wherein the rods include an opening extending perpendicularly through the rod with the opening being sized to accommodate a pin;

a rack attached to the platform and extending perpendicular from the platform;

an upper barrier attached to the rack and parallel to the platform;

a mid-rail connector having a first end connected to the upper barrier and a coupler at a second end, opposite of the first end, the coupler positioned between the upper barrier and the platform, wherein the mid-rail connector extends to a position between the upper barrier and the platform and is unattached to the platform;

a pole extending through the coupler of the mid-rail connector and through a first bracket attached to the rack and a second bracket attached to a second rack, wherein the first bracket is attached to a front side of the rack and positioned above the platform.

2. The scaffold of claim 1, wherein the pin is a D-clip.

3. The scaffold of claim 1, further comprising a base adapted to support the rails.

4. The scaffold of claim 3, further comprising a guide coupled to the base and extending above a top surface of the base.

* * * * *